United States Patent [19]

Fujishiro et al.

[11] 4,145,258

[45] Mar. 20, 1979

[54] APPARATUS FOR PREVENTING GAS LEAKAGE FROM OVEN DOOR OF COKE OVEN

[75] Inventors: Koretoshi Fujishiro; Masamitsu Hiyoshi, both of Kagawa, Japan

[73] Assignee: Mitsubishi Kasei Kogyo Kabushiki Kaisha, Tokyo, Japan

[21] Appl. No.: 781,297

[22] Filed: Mar. 25, 1977

[51] Int. Cl.[2] ..... C10B 25/18

[52] U.S. Cl. ..... 202/248; 202/269

[58] Field of Search ..... 202/248, 254, 263, 269; 110/179, 173 R

[56] References Cited

U.S. PATENT DOCUMENTS

| | | | |
|---|---|---|---|
| 3,926,740 | 12/1975 | Krikau | 202/254 X |
| 3,928,144 | 12/1975 | Jakimowicz | 202/263 |
| 3,933,595 | 1/1976 | Gordon et al. | 202/263 X |
| 3,957,591 | 5/1976 | Riecker | 202/263 |

*Primary Examiner*—Morris O. Wolk
*Assistant Examiner*—Arnold Turk
*Attorney, Agent, or Firm*—Oblon, Fisher, Spivak, McClelland & Maier

[57] ABSTRACT

In a coke oven of the type comprising an oven opening, an oven door for closing the oven opening, a knife-edge surrounding the oven door for forming a seal for preventing leakage of oven gas, there are provided a conduit arranged along the outside periphery of the oven opening and provided with a plurality of gas ejection nozzles, and means for supplying compressed gas to the conduit. The gas ejection nozzles are directed such that gas is blasted to the seal.

5 Claims, 7 Drawing Figures

APPARATUS FOR PREVENTING GAS LEAKAGE FROM OVEN DOOR OF COKE OVEN

BACKGROUND OF THE INVENTION

1. Field of the Invention

This invention relates to apparatus for preventing gas leakage through the seal of the oven door of a coke oven, and more particularly, apparatus for preventing oven gas generated during distillating operation from leaking out of an oven chamber through a sealing part between an oven opening and an oven door mounted to the oven opening of a coke oven.

2. Description of the Prior Art

The oven door of a conventional horizontal coke oven such as Otto-type, Kopper-type and Carl Still-type is operated to close an oven opening of a coke oven during distillating operation, and the gap between the oven opening and the oven door is sealed by a knife-edge. However, in such a horizontal coke oven, there occurs a case where the seal of the door is not complete because of incomplete setting of the door to the opening and adhesion of tar and/or pitch to the door frame of the door and the knife-edge attached to the door. The coal distillation gas leaks from the oven chamber outwardly through the gap between the door frame and the knife-edge. Furthermore, the door is heated to an extremely high temperature and deformed. This causes the heat deformation of the knife-edge and in turn the leakage of the gas. By such gas leakage the environment of the coke oven is impaired and public hazards, for example, air pollution, are caused. They present difficult problems for the coke manufacturing industry.

SUMMARY OF THE INVENTION

Accordingly, a principal object of this invention is to provide apparatus for preventing effectively gas leakage from the oven opening of a coke oven during distillating operation thereby improving the environment of the coke oven and preventing the generation of public hazards such as air pollution.

Another object of this invention is to provide apparatus for effectively preventing the gas leakage without changing the construction of the existing oven door of a horizontal coke oven.

A further object of this invention is to provide apparatus for effectively preventing the gas leakage with an extremely small energy.

According to this invention, in a coke oven of the type comprising an oven opening, an oven door for closing the oven opening, a knife-edge surrounding the oven door for forming a seal for preventing leakage of oven gas, the improvement comprises a conduit arranged along the outside periphery of the oven opening and provided with a plurality of gas ejection nozzles, and means for supplying compressed gas to the conduit, and the gas ejection nozzles are directed such that gas is blasted to the seal. The blasted gas effectively cools the knife-edge, the door and the door frame thereby reducing the thermal distortions thereof and promotes adhesion of tar and/or pitch thereby increasing the sealing effect.

BRIEF DESCRIPTION OF THE DRAWINGS

Other objects and advantages of this invention will be apparent from the following detailed descriptions taken in conjunction with the accompanying drawings, in which.

DESCRIPTION OF THE PREFERRED EMBODIMENT

Figure 1:
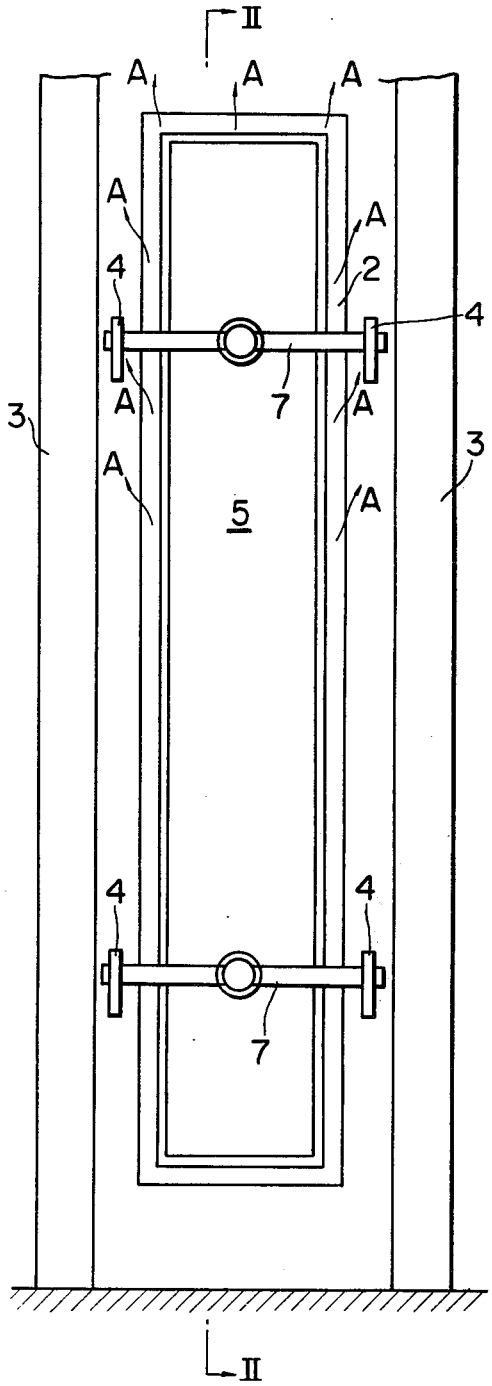
FIG. 1 is a plan view showing an oven opening of a horizontal coke oven with the oven door closed.

As shown, a coke oven according to this invention comprises an oven opening 1, a door 5, a door frame 2, buckstays 3, hook members 4 for holding the door 5, a knife-edge 6 secured to the door, locking bars 7 attached to the door, a conduit 8, a plurality of gas ejection nozzles provided for the conduit 8, an on-off operation cock 10 positioned at a position convenient for the operator and members for fixing the conduit 8 to the buckstay 3. The coke oven may further comprise a source of compressed gas S such as a conventional air compressor or a steam generator.

Figure 2:
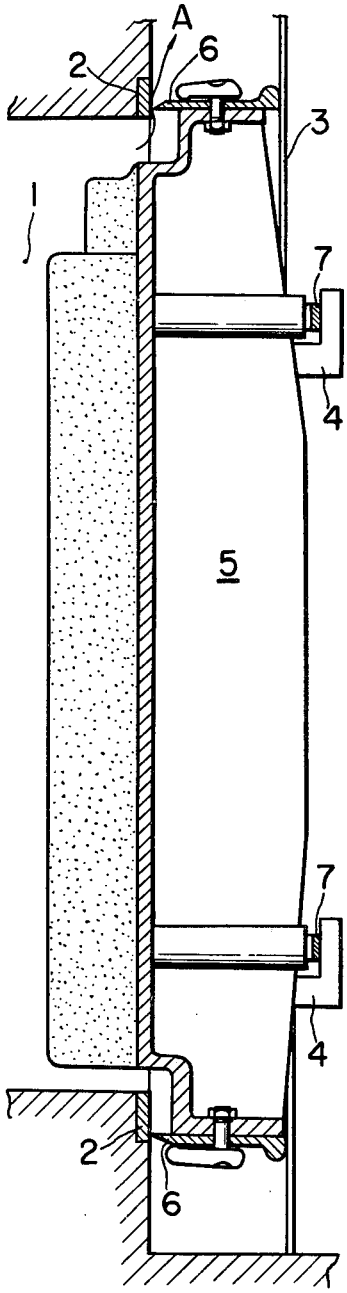
FIG. 2 shows a vertical cross-section taken along the line II—II in FIG. 1.

As shown in FIGS. 1 and 2, the door opening 1 of a horizontal coke oven is usually closed by a door 5 during distillating operation, and the knife-edge 6 is secured to the door 5 and the front end of the knife-edge is caused to abut against the door frame 2 to seal the gap therebetween. However, sometimes the seal is not complete because of the thermal distortions of the door 5 and of knife-edge 6, wear of the door or the knife-edge and adhesion of tar and/or pitch to these parts. Such incomplete seal causes leakage of distillation gas as shown by arrows A in FIGS. 1 and 2.

Figure 3:
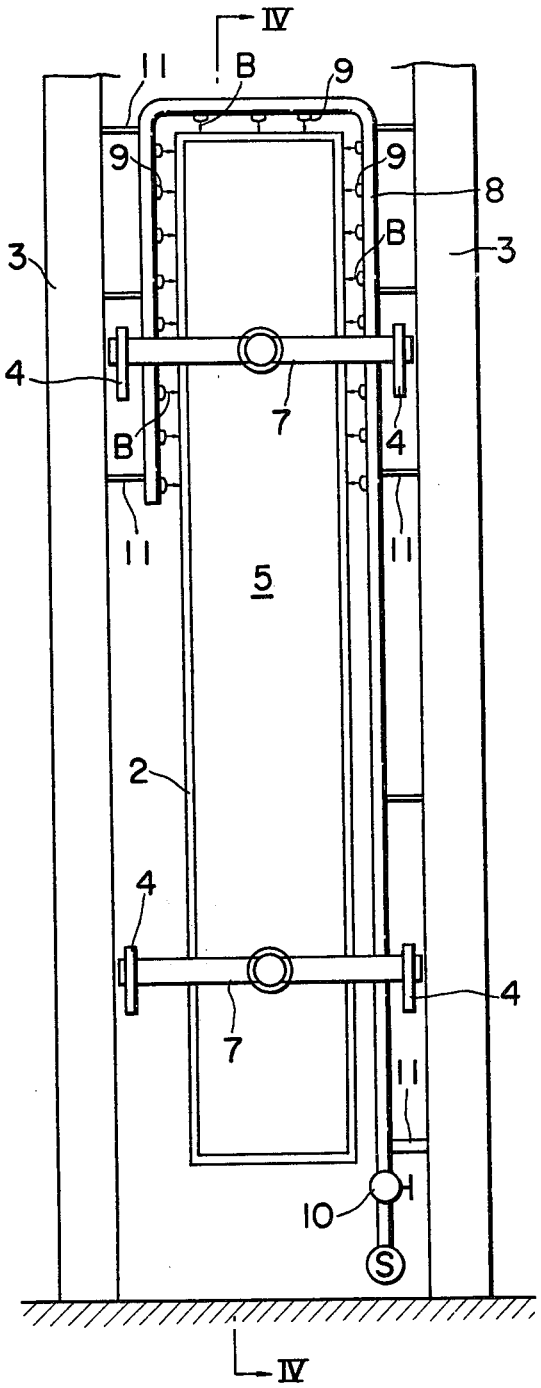
FIG. 3 is a plan view of a coke oven including the apparatus according to this invention.
Figure 4:
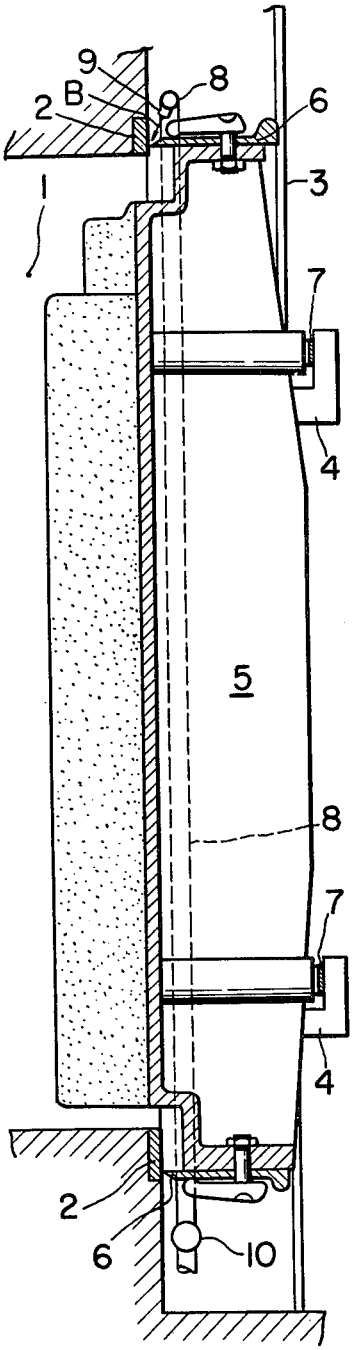
FIG. 4 is a vertical cross-sectional view taken along the line IV—IV in FIG. 3.
Figure 5:
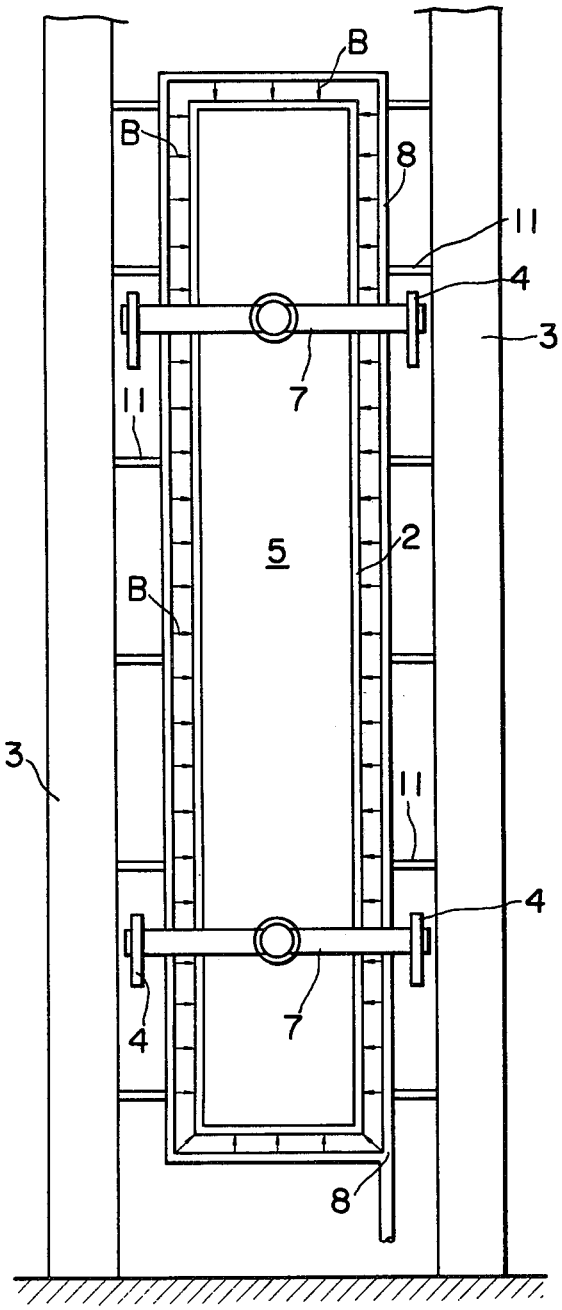
FIG. 5 is a plan view of a coke oven showing another embodiment of the apparatus according to this invention.

As shown in FIGS. 3 through 5, according to this invention, the coke oven is provided with a conduit 8 having a plurality of gas ejection nozzles 9 along the outside periphery of the oven opening 1 for preventing the gas leakage through the gap between the knife-edge 6 and the door frame 2. Compressed gas, usually air, is blasted to the gap as shown by arrows B from the portion external of the knife-edge 6 through the gas ejection nozzles. In FIG. 3, the conduit 8 extends along one side, the top side and a portion of the other side of the door 5 and one end of the conduit extends towards the bottom of the coke oven through an on-off cock 10 to the source of compressed gas S. The conduit 8 is supported by buckstays 3 through fixing members 11, and when the cock 10 is opened and the compressed gas is supplied to the conduit 8, the gas is blasted to the gap between the knife-edge 6 and the door frame 2 through the gas ejecting nozzles 9 as shown by arrows B. This gas blast acts strongly to prevent the gas leakage from the oven chamber through the gap.

In a modified embodiment shown in FIG. 5 the conduit 8 surrounds the entire periphery of the oven opening 1 thereby blasting the gas to prevent the gas leakage from the whole periphery of the door 5.

Figure 6:
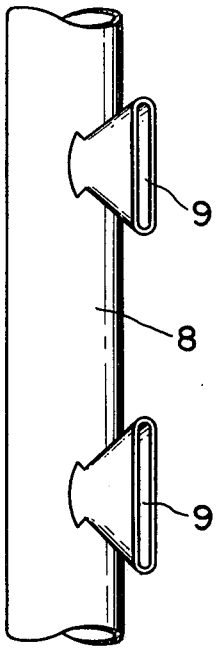
FIG. 6 is a perspective view of one example of gas ejection nozzles utilized in this invention.

FIG. 6 shows a portion of conduit 8 including dovetail shaped nozzles 9 for blasting the gas in the form of a fan.

Figure 7:
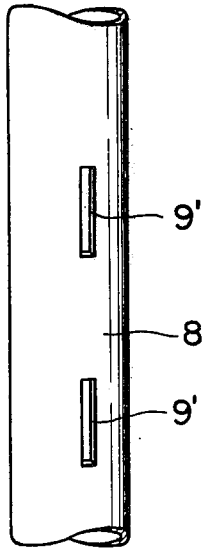
FIG. 7 is a perspective view showing another example of gas ejection nozzles.

FIG. 7 shows a portion of conduit 8 including nozzles 9' in the form of slits.

Air, inert gas or steam may preferably be used as compressed gas to be blasted from the gas ejection nozzles 9, but gas at a temperature below 120°, preferably at normal temperature, is preferred because the gas blast at such temperature cools effectively the knife-edge 6, the door 5 and the door frame 2 at the opening 1 thereby reducing the thermal distortions of the knife-edge 6 and door frame 2. The blast of the cooling gas promotes the adhesion of tar and/or pitch to the gap between the knife-edge and the frame and enhances the sealing effect at the gap therebetween. Furthermore, it was found that the preferred inclination angle of the blast of the gas ejection with respect to the surface of the door frame 2 ranges from 30° to 50°.

EXAMPLE

In a case where Carl Still-type coke oven with an oven opening having a height of 7m was used, distillation gas leakage was detected at the top of the oven opening and along the both sides thereof for a length of 1.2m from the top. Under these conditions, a conduit having a plurality of gas ejection nozzles was attached to this coke oven as shown in FIGS. 3 and 4, wherein:

Diameter of conduit: 50mm

Size of nozzle: 3mm × 1.5mm

Spacing between adjacent nozzles: 100mm

Angle of gas blast with respect to the surface of door frame: 45°

Distance from between the front end of knife-edge to nozzle: 100mm

Blasting pressure: 2 kg/cm$^2$

The leakage of the distillation gas was perfectly stopped by the continuous blasting of the cool gas through nozzles.

It is to be understood by those skilled in the art that the foregoing description refers to some preferred embodiments of this invention and the various modifications and changes may be made without departing from the scope and spirit of the invention as defined in the appended claims.

We claim:

1. In a coke oven of the type comprising a door frame defining an oven opening, an oven door for closing the oven opening, and a knife-edge surrounding the oven door for forming a seal line to the door frame for preventing leakage of oven gas, the improvement which comprises a conduit arranged along the outside periphery of said oven opening and provided with a plurality of cooling gas ejection nozzles at least along one side, the top side, and the other side of said oven opening, and means for supplying compressed cooling gas to said conduit, said cooling gas ejection nozzles being directed such that cooling gas is blasted inwardly towards said seal line between said knife-edge and said door frame when said door is closed, whereby said seal line is cooled and gas leakage therethrough is reduced.

2. The apparatus according to claim 1 wherein said conduit having a plurality of gas ejection nozzles extends along the entire periphery of said oven opening.

3. The apparatus according to claim 1 wherein said conduit having a plurality of gas ejection nozzles is fixed to buckstays of the coke oven.

4. The apparatus according to claim 1 wherein an on-off cock is connected between said conduit and said gas supply means.

5. The apparatus according to claim 4 wherein said on-off operation cock is positioned at a position convenient for operators.

* * * * *